US005634483A

United States Patent [19]

Gwin

[11] Patent Number: 5,634,483

[45] Date of Patent: Jun. 3, 1997

[54] CANOPY SUPPORT SYSTEM

[76] Inventor: Robert E. Gwin, 816 Shenango Rd., Beaver Falls, Pa. 15010

[21] Appl. No.: 573,555

[22] Filed: Dec. 15, 1995

[51] Int. Cl.[6] ..... E04H 15/38; E04H 15/46; E04H 15/50

[52] U.S. Cl. ..... 135/131; 135/87; 135/124; 135/135; 135/115; 135/117; 135/157; 135/158

[58] Field of Search ..... 135/907, 131, 135/87, 123, 135, 145, 115, 117, 120.4, 157, 158, 159, 124

[56] References Cited

U.S. PATENT DOCUMENTS

| | | | |
|---|---|---|---|
| 1,204,616 | 11/1916 | Upton . | |
| 1,249,883 | 12/1917 | Baldwin . | |
| 1,581,331 | 4/1926 | Smith . | |
| 2,186,535 | 1/1940 | MacGeorge . | |
| 2,516,894 | 8/1950 | Lushbavgh | 135/120.4 |
| 2,538,018 | 12/1951 | Williams | 135/158 |
| 2,716,992 | 9/1955 | Campfield et al. | 135/120.1 X |
| 4,558,713 | 12/1985 | Hagler et al. | 135/120.3 X |
| 4,641,676 | 2/1987 | Lynch | 135/115 X |
| 4,880,024 | 11/1989 | Brell | 135/907 X |
| 5,035,253 | 7/1991 | Burtles | 135/117 X |
| 5,224,507 | 7/1993 | Vosse | 135/115 X |
| 5,274,980 | 1/1994 | Zeigler | 135/123 X |
| 5,487,402 | 1/1996 | Clary | 135/120.4 X |
| 5,490,532 | 2/1996 | Mallookis et al. | 135/157 X |

FOREIGN PATENT DOCUMENTS

| | | |
|---|---|---|
| 106354 | 1/1967 | Denmark . |
| 1159434 | 6/1958 | France . |

*Primary Examiner*—Wynn E. Wood
*Attorney, Agent, or Firm*—Harpman & Harpman

[57] ABSTRACT

A canopy support system to support the canopy portion of a self-contained collapsible canopy type tent. The canopy support system has a plurality of interconnected resilient cord elements extending from a central hub to multiple support frame attachment points around the collapsible metal frame of the tent. The resilient cords are adjustable for required tension and provide intermediate canopy support between a central support pole and the perimeter support frame.

4 Claims, 2 Drawing Sheets

CANOPY SUPPORT SYSTEM

BACKGROUND OF THE INVENTION

1. Technical Field

This device relates to display canopy type tents characterized by a lightweight collapsible integral frame and telescopically extensible leg support to provide an elevated canopy support frame without intervening sidewalls used in display and show environments.

2. Description of Prior Art

There are no known prior art devices to supplement support of a canopy type tent. Such tent support structures known have a variety of different support frameworks, see for example U.S. Pat. Nos. 1,204,616, 1,249,883, 1,581,331, 2,186,535 and 3,008,477. Foreign references, see Danish patent 106354 and French reference 1,159,434.

In U.S. Pat. No. 1,204,616 a portable frame for tents is disclosed having a center support pole with multiple support areas extending thereto with interconnected arm support rods extending therefrom to a central support pole.

U.S. Pat. No. 1,249,883 is directed to a sectional tent having a number of guide ropes extending from the loop section to a series of ground engagement stakes.

U.S. Pat. No. 1,543,134 on a shelter shows a plurality of ridge support rods extending from a central hub to a perimeter frame.

U.S. Pat. No. 1,581,331 illustrates a tent structure having a ground engaging center support post with multiple support ropes extending from a central hub to act as wind braces.

U.S. Pat. No. 3,008,477 discloses a collapsible portable shelter having a plurality of telescopically extensible support posts from which extends interconnecting upper ridge support rods to a central support hub.

U.S. Pat. No. 2,186,535 has a pyramid type hatch tent that provides temporary cover to open hatch ways of maritime vessels. Multiple guide ropes extend from a central pulley suspended from a depending line thereabove.

In French patent 1,159,434 a tent structure is disclosed having multiple ridge poles from which extend upper support guide wires secured to a central support plate having a support post extending upwardly therefrom. Ropes extend from the perimeter support posts to the central post.

Finally, in Danish patent DK106354 a support wire frame is illustrated extending from a central support ground engaging post and a pair of hubs thereon in spaced vertical relation to one another.

SUMMARY OF THE INVENTION

A supplemental canopy support device having a plurality of interconnected independent resilient support cords adjustably positioned to the perimeter frame of a canopy type display tent and a central support hub on a central support post. Each resilient cord is independently adjustable for effective tension to prevent canopy sag during heavy rains and the like.

DESCRIPTION OF THE PREFERRED EMBODIMENT

Figure 1:
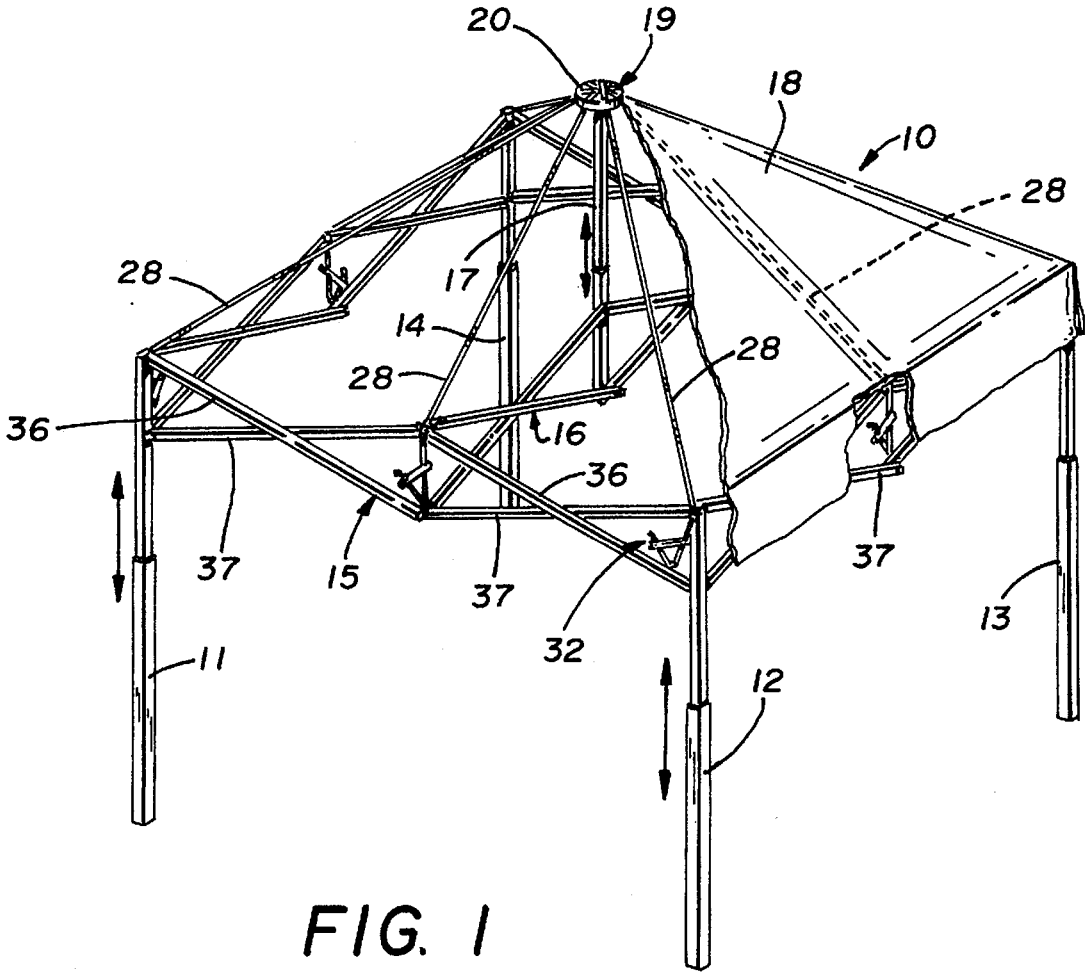
FIG. 1 is a perspective view of a canopy tent with the canopy support device of the invention installed thereon.

Referring to FIG. 1 of the drawings, a canopy tent 10 can be seen having multiple support legs 11, 12, 13, and 14. Each of the legs 11–14 are telescopically extensible with interconnected collapsible support structures 15 extending therebetween defining a square shaped frame support when fully extended. A center cross support structure 16 extends between two of the opposing support structures 15 and has a center support post 17 extending upwardly therefrom. Typically, the above described canopy tent 10 has a waterproof covering 18 that extends over the support posts 17 and the interconnected support structures 15 enclosing the upper portion as will be well known to those skilled in the art.

Figure 2:
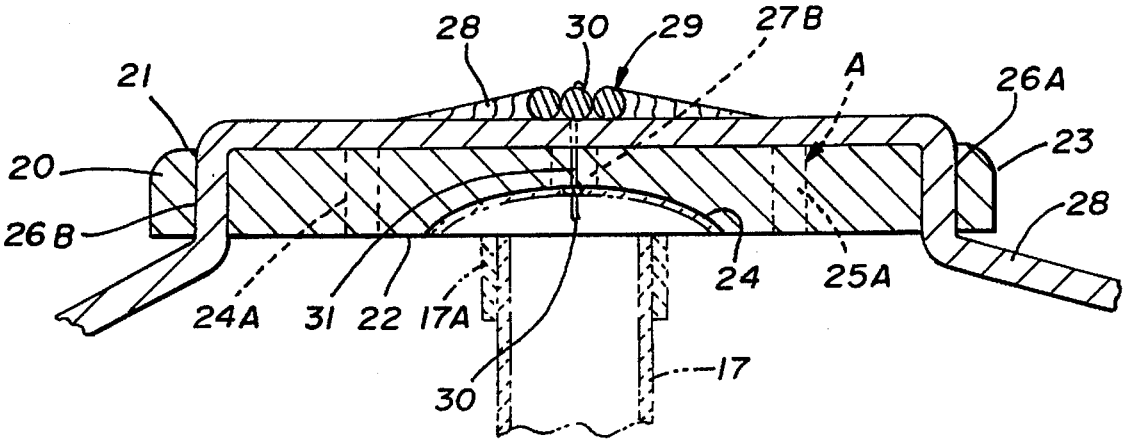
FIG. 2 is an enlarged cross-sectional view on lines 2—2 of the support hub of FIG. 3.
Figure 3:
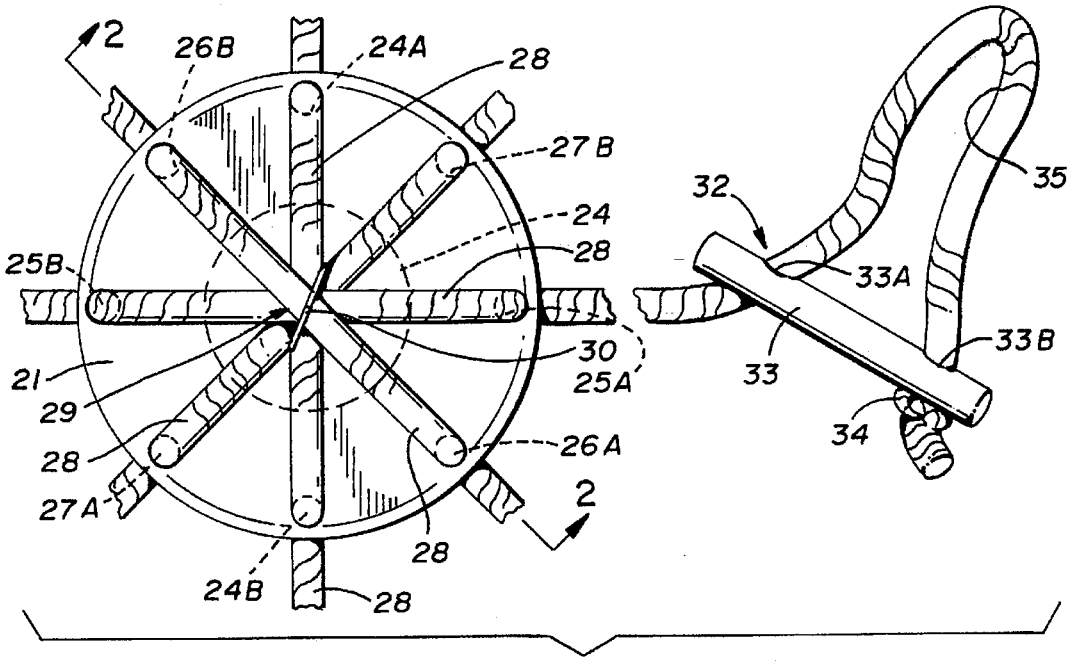
FIG. 3 is a top plan view of a central support hub of the invention with attached interconnecting resilient support cords with attached adjustments thereto.

A canopy support 19 of the invention can be seen in FIGS. 1, 2, and 3 of the drawings having a central support annular hub 20 having a top portion 21, a bottom portion 22 and a continuous perimeter edge 23. The hub 20 has a plurality of annularly spaced apertures A extending vertically therethrough and spaced inwardly from its perimeter edge 23. A concave recess 24 is centered in the bottom portion 22 of the hub 20, best seen in FIG. 2 of the drawings defining a registration area for a contoured engagement plate fitting 17A on the center support post 17's respective free end.

The apertures A within the hub 20 are so positioned as to define oppositely disposed selective apertured pairs 24A and B, 25A and B, 26A and B and 27A and B as best seen in FIG. 2 of the drawings.

Each of the selected apertured pairs received an elastic (bungeed) cord 28 therethrough extending outwardly from the bottom portion 22 through, as an example apertured pair 26A across the hub's top portion 21 and downwardly through the opposing apertured pair 26B, best seen in FIGS. 2 and 3 of the drawings. It will be apparent that the multiple elastic cords 28 extend through the respective apertured pairs 24AB, 25AB, 26AB and 27AB that multiple cord overlap intersection will occur at a point 29 centered on the top portion 21 of the hub 20. To help support the cords 28 intersection at 29 a retaining strap 30 loops thereover and down through a central bore at 31 in the hub 20 with the straps 30 free ends twisted together with the recess 24. Each of the elastic (bungee) cords 28 have adjustment assemblies 32 on their respective ends, best seen in FIGS. 3, 4, and 5 of the drawings. The cord adjustment assembly 32 has a tension bar 32 with oppositely disposed transversely extending apertures therethrough at 33A and 33B through which one of the cords 28 extends. The cord's respective free ends are knotted at 34 after passing through the aperture at 33B securing the tension bar 33 thereon forming an adjustment cord loop 35. The cords adjustment assemblies 32 are removably secured to their respective support structures 15 adjacent the support legs 11–14 as seen in FIG. 4 of the drawings and secured midway therebetween on said support frames as illustrated in FIG. 5 of the drawings, defining eight points of attachment thereto.

Figure 4:
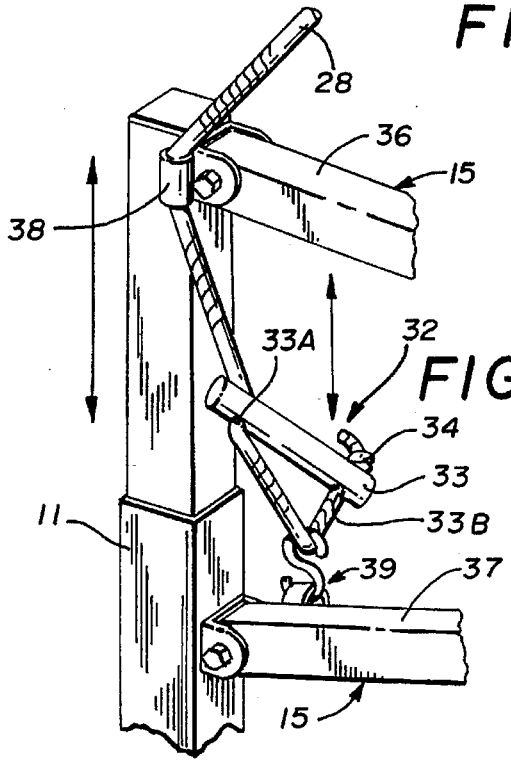
FIG. 4 is an enlarged perspective view of the attachment and adjustment fasteners of the invention secured to the canopy tent support.
Figure 5:
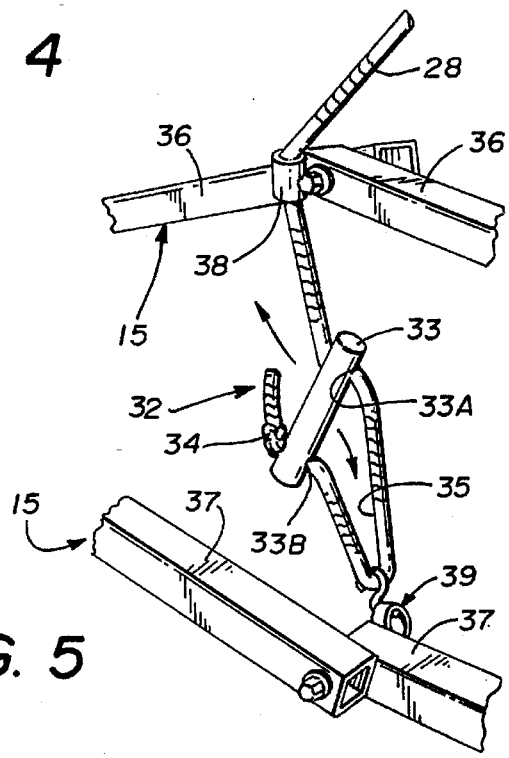
FIG. 5 is an enlarged perspective view of the attachment and adjustment fasteners of the invention secured to the supplemental support frame of the tent.

The support structures 15 have pairs of cross tubular elements 36 and 37 pivotally secured to the support legs 11–14 in FIG. 4 of the drawings and to one another as illustrated in FIG. 5 of the drawings by pivot points P.

Tubular cord guides 38 are secured to their respective tubular elements 36 adjacent the respective support legs and midway therebetween through which the cords 28 extend. An open hook assembly 39 is secured to the lower tubular element 37 opposite the hereinbefore described cord guides 38. The cord loop 35 engages the hook assembly for cord length and corresponding cord tension adjustment by slideably repositioning the bar 33 on the cords as will be well understood by those skilled in the art.

In use, the hub 20 with attached elastic (bungee) cords 28 are secured to the engagement plate fitting 17A on the center support post 17 and the extending cords 28 are adjustably secured to the support frames 15 defining an equal distance thereabout. The cords 28 are adjusted to desired tension by the independent adjustment assemblies 32 as illustrated in FIGS. 4 and 5 of the drawings. The waterproof covering 18 is positioned over the frame supports 15, canopy support 19 and center pole 17 as illustrated in FIG. 1 of the drawings wherein the elastic cords 28 provide intermediate spaced radial support under the waterproof cover 18.

Thus it will be seen that a new and useful canopy support system has been illustrated and described and it will be apparent to those skilled in the art that various changes and modifications may be made therein without departing from the spirit of the invention.

Therefore I claim:

1. A canopy support on a canopy tent; said canopy tent having a support frame, multiple support legs extending from said support frame, collapsible support structures extending between said support legs, a central support structure having a central support post extending therefrom; and a covering position thereover, said canopy support comprising; a central hub on said central support post, a plurality of apertures in said central hub, multiple elastic cords extending from said central hub to said collapsible support structures, means on said elastic cords for adjustably securing said elastic cords to said collapsible support structures, said elastic cords extending through said apertures in said central hub in criss-cross overlapping configuration to one another, each of said elastic cords extending through said oppositely disposed apertures in said central hub, a recessed area in said central hub, and engagement plate on said central support post removably secured within said recessed area of said central support hub.

2. The canopy support set forth in claim 1 wherein said means on said cords for adjustably securing said cords to said collapsible support structure comprises an apertured bar threadably positioned on said cords, a cord loop extending from said bar, cord guides on said collapsible support structures between said hub and said bar, cord engagement hooks on said collapsible support structures engageable on said cord loop portions of said cord.

3. The canopy support set forth in claim 2 wherein said cord guides are positioned on an upper tubular element of said collapsible support structure and said cord engagement hooks are positioned on a respective lower tubular element of said collapsible support structure in spaced vertical relation to one another.

4. The canopy support set forth in claim 1 wherein said elastic cords extending through oppositely disposed apertures define multiple radial support for said covering position thereover.

* * * * *